United States Patent [19]

Nise et al.

[11] 4,214,337

[45] Jul. 29, 1980

[54] FLOOR POLISHER

[75] Inventors: Wilfred C. Nise, Spring Lake, Mich.; Bertel S. Nelson, Naperville, Ill.

[73] Assignee: Clarke-Gravely Corporation, Muskegon, Mich.

[21] Appl. No.: 39,313

[22] Filed: May 16, 1979

[51] Int. Cl.[2] ..... A47L 11/162

[52] U.S. Cl. ..... 15/49 R; 51/177; 308/187.1

[58] Field of Search ..... 15/49 R, 50 R, 51, 52, 15/87, 180, 385; 51/170 T, 177; 74/421; 308/36.1, 187.1

[56] References Cited

U.S. PATENT DOCUMENTS

| | | | |
|---|---|---|---|
| 1,847,323 | 3/1932 | Yutzler et al. | 15/49 R |
| 2,026,006 | 12/1935 | Wennerstrom | 15/49 R X |
| 2,218,893 | 10/1940 | Schlesinger | 15/49 R X |
| 2,221,315 | 11/1940 | Okun | 15/49 R X |
| 2,468,929 | 5/1949 | Holt et al. | 15/49 R X |
| 2,674,896 | 4/1954 | Arones | 15/49 R X |
| 3,011,190 | 12/1961 | Wilke | 15/49 R |
| 3,074,089 | 1/1963 | Brown, Jr. | 15/49 R |
| 3,087,078 | 4/1963 | Brown | 15/49 R X |

*Primary Examiner*—Edward L. Roberts

*Attorney, Agent, or Firm*—Price, Heneveld, Huizenga & Cooper

[57] ABSTRACT

A compact floor polisher is disclosed including a base supporting an electric motor having a vertically oriented output shaft and driving a circular brush. The base includes a depending annular skirt and a hollow hub. A brush carrier has an annular flange and a spindle rotatably supported by bearings within the hub. The brush carrier and support base define a lubricant housing. A ring gear is formed on the annular flange of the carrier and engaged by a pinion gear secured to the motor output shaft. A seal is disposed between the vertical flange and the annular skirt. A breather passage is defined by the base and extends into the lubricant housing. Baffles direct lubricant into the hub to lubricate the bearings supporting the brush carrier spindle.

27 Claims, 7 Drawing Figures

FLOOR POLISHER

CROSS REFERENCE TO RELATED APPLICATION

This application is related to application Ser. No. 39,314, filed on even date herewith in the name of Bertel S. Nelson and entitled FLOOR POLISHER WITH GEAR DRIVE.

BACKGROUND OF THE INVENTION

The present invention relates to floor maintenance apparatus and more particularly to rotary floor polishers.

Floor maintenance machines are used for scrubbing, stripping, polishing or buffing a floor surface. Such machines typically have a rotary floor treating element engaging the floor surface and rotated about its vertical axis by an electric motor, a drive transmission between the motor and the brush and an operator's handle. The machine rests on the floor surface and is typically swept through an arc by variations in pressure exerted on the control handle by the operator. In commercial applications, such machines are subjected to heavy use and must be reliable in operation. Reliability may be sacrificed due to competing desirable attributes such as ease of operation, ease of maintenance, ease of storage, low noise levels during operation and ease of and cost of manufacture.

Examples of prior floor maintenance machines may be found in U.S. Pat. No. 1,847,323, entitled FLOOR MACHINE and issued on Mar. 1, 1932 to Yutzler et al, U.S. Pat. No. 2,348,268, entitled FLOOR SCRUBBING MACHINE and issued on May 9, 1944 to Smith, U.S. Pat. No. 2,561,279, entitled FLOOR MAINTENANCE MACHINE and issued on July 17, 1951 to Holt, U.S. Pat. No. 2,817,977, entitled DRIVE UNIT FOR FLOOR TREATING MACHINES and issued on Dec. 31, 1957 to Holt, U.S. Pat. No. 3,074,089, entitled COMPACT MACHINE and issued on Jan. 22, 1963 to Brown, Jr., and U.S. Pat. No. 3,619,848, entitled APPLIANCE FOR CLEANING FLOORS and issued on Dec. 16, 1971 to Salzmann.

Prior art devices such as disclosed in the aforementioned U.S. Pat. No. 2,817,977 have supported the drive motor in co-axial relationship with a gear reduction unit and the circular brush element. The unit of this patent includes a closed chamber within which multiple gear sets transmit rotary motion. A liquid lubricant is employed to increase the life and hence reliability of the floor treating machine and also reduce noise levels associated with operation.

Mounting the drive motor in co-axial alignment with a drive unit and the brush element results in a vertical height of the polisher which may restrict the areas of usage of the device due to interference with structures found in a building. For example, the machine may not fit under tables or shelves. Also, prior drive units and lubrication arrangements have not permitted the polishers to be stored readily. The polishers typically must be stored in an upright position since the lubricant will leak if the polisher is tipped on its side or stored upside down. If the housing is sealed and closed, excessive pressure may build up resulting in leakage from gaskets and seals during use unless complex, expensive seals are used.

Previous attempts to reduce the overall vertical height of the floor treating machines have included offsetting the electric motor from the vertical centerline of the rotary brush. An example of such an arrangement may be found in the aforementioned U.S. Pat. No. 1,847,323. A floor polisher is disclosed therein wherein the drive motor is mounted on a base plate in a position offset from the vertical centerline of a circular brush. Rotary motion is transmitted to the brush by a drive arrangement including a pinion gear secured to a vertically oriented motor output shaft and a ring gear carried by a brush carrier. The pinion gear and ring gear are positioned within a housing which defines a sealed lubricant chamber. With such an arrangement, problems may be experienced with excessive build up of pressure within the housing due to heat generated during operation. Also, problems may be experienced with providing adequate lubrication for a bearing structure which supports the brush carrier for rotary motion relative to the housing. Other problems which have been experienced with the prior art floor polishers as illustrated in the aforementioned patents are related primarily to difficulties in manufacture, complexity and in performing routine maintenance on the machines.

SUMMARY OF THE INVENTION

In accordance with the present invention, a unique compact floor treating machine and drive unit are provided whereby the problems heretofore experienced with respect to complexity, difficulty of manufacture, noise of operation, sealing, maintenance, storage and reliability are substantially alleviated or eliminated. Essentially, the machine includes a drive having a motor support base including an annular skirt and a hollow hub. A carrier includes an annular flange and a spindle. Bearing means are provided for supporting the spindle for rotary motion within the hub. Gearing interconnects the carrier with the vertically oriented output shaft of a motor. Provision is made for sealing the space between the vertical flange and annular skirt, for venting the space defined by the base plate and the carrier to atmosphere, and for directing lubricant into the hub to lubricate the bearing means supporting the spindle. The floor machine may be stored in any position without loss of lubricant.

DETAILED DESCRIPTION OF THE PREFERRED EMBODIMENT

Figure 1:
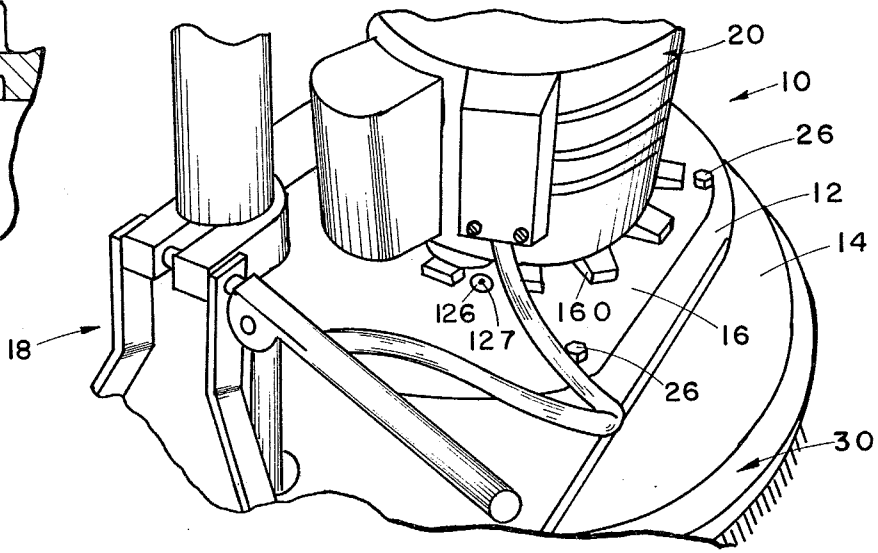
FIG. 1 is a fragmentary, perspective view of the compact floor treating machine in accordance with the present invention.

A compact rotary floor treating machine or floor polisher in accordance with the present invention is illustrated in FIG. 1 and generally designated 10. Machine 10 includes a frame 12 having a housing 14 secured thereto, a base plate 16 and operator's handle 18. Supported on base plate 16 is a motor housing 20 within which is disposed a conventional electric motor 22 having a vertically oriented output shaft 24. Base plate 16 is secured to frame 12 by suitable fasteners 26. As described in detail below, electric motor 22 rotates a rotary floor treating element 30 which is illustrated in FIG. 1 as a floor polisher brush. The brush 30 is rotated about its vertical axis.

Figure 2:
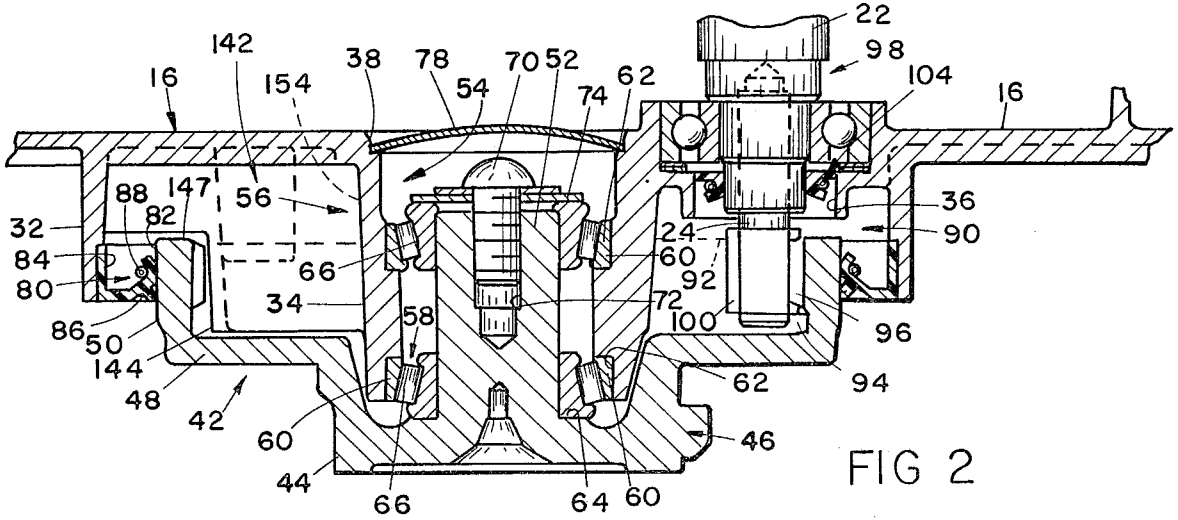
FIG. 2 is a fragmentary, cross sectional view of the floor treating machine showing the drive unit in accordance with the present invention.

As best seen in FIG. 2, base plate 16 is preferably a die cast member including an integral, depending, annular skirt 32 and a depending, hollow, cylindrical hub 34 concentrically positioned with skirt 32. Base plate 16 further defines a motor shaft aperture 36 and a bearing access aperture 38. Rotary floor treating element or brush 30 is detachably secured to a carrier 42. Carrier 42 includes a central hub 44 to which brush 30 is detachably secured in a conventional fashion by lugs 46. Carrier 42 is generally cup-shaped in section and includes a base or bottom wall 48, a peripheral, vertically extending, annular flange 50 and a centrally disposed, vertically extending spindle or shaft 52. Shaft 52 is concentric with flange 50.

Spindle 52 is supported for rotary motion within bore 54 of hub 34 by a pair of vertically spaced tapered roller bearing assemblies 56, 58. Each roller bearing assembly 56, 58 includes an outer race 60 pressfit within a suitable groove 62 formed in the inner periphery of hub 34. Inner races 64 encircle spindle 52 and a plurality of tapered roller bearings 66 run on the races 60, 64. The tapered roller bearings in co-action with the races support and fix the spindle 52 within the hub 34. Preloading of the roller bearings is easily and readily accomplished by a single adjustment member or bolt 70. Spindle 52 is bored and threaded at 72 and the head of the bolt 70 engages a washer or plate 74. Plate 74 in turn engages the inner race 64 of upper bearing assembly 56. This secures the spindle within the hub. Tightening bolt 70 exerts a force on race 64 which in turn preloads the tapered roller bearing assemblies. Access to the adjustment bolt 70 is had through aperture 38. Aperture 38 is in turn closed and sealed by a resilient, metal cap or cover 78. Cover 78 is snapped into aperture 38 and held against the grooved sidewalls of the aperture.

As seen in FIG. 2, vertical flange 50 of carrier 42 telescopes within and overlaps with the depending annular skirt 32 of base plate 16. A suitable rotary seal 80 is carried by depending skirt 32 and sealingly engages the outer peripheral surface 82 of vertical flange 50. Seal 80 may be of any suitable type. As illustrated, seal 80 includes a carrier 84, a resilient sealing member 86 and a garter spring 88. Spring 88 biases sealing member 86 into sealing engagement with surface 82.

Base plate 16 and carrier 42 define a drive housing or chamber 90 which contains a suitable amount of liquid lubricant. The housing is filled with lubricant to a level indicated by the dotted line 92 in FIG. 2.

Machined into the inner peripheral surface 94 of vertical flange 50 is a ring gear 96. Motor 22 is secured to the base plate 16. Vertically oriented output shaft 24 is supported by suitable ball bearing structure 98 and has secured thereto a pinion gear 100. Pinion gear 100 meshes with the ring gear 96 and the motor is offset from the vertical centerline of the carrier 42 (FIG. 3) and hence the vertical centerline of the rotary floor treating element 30. A rotary seal 104 is disposed within aperture 36 and engages the shaft 24 to prevent loss of lubricant through the shaft opening. It is preferred that carrier 42 be die cast and machined so that gear 96 is integral therewith. In the alternative, gear 96 could be a separate element carried by flange 50.

As should be readily apparent, rotary motion of the output shaft 24 is transmitted to the carrier 42 and hence the floor treating element 30 through pinion gear 100 and ring gear 96. Offsetting of the motor relative to the vertical centerline of the carrier 42 reduces the overall height of the polisher when compared to prior co-axially aligned motor and multiple gear set reduction units.

Figure 5:
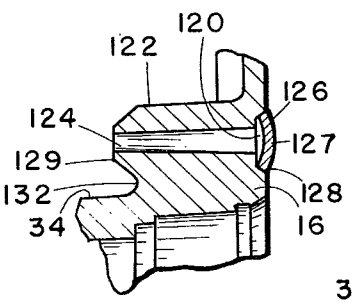
FIG. 5 is a cross sectional view taken generally along line V—V of FIG. 3.
Figure 4:
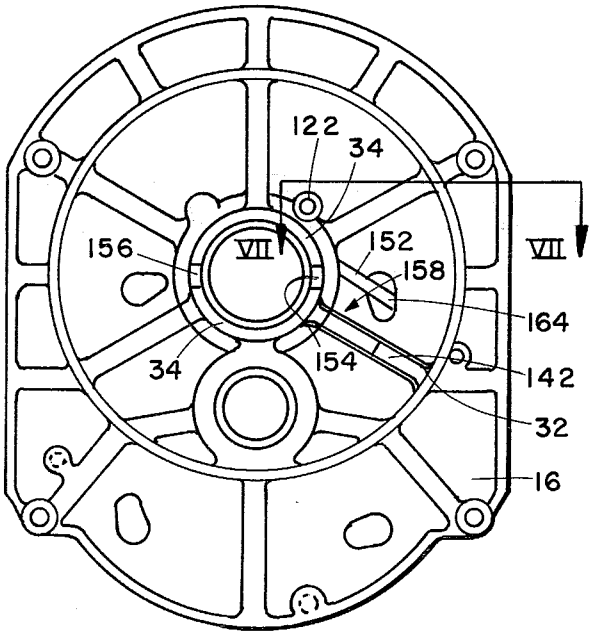
FIG. 4 is a bottom plan view of the base plate.
Figure 3:
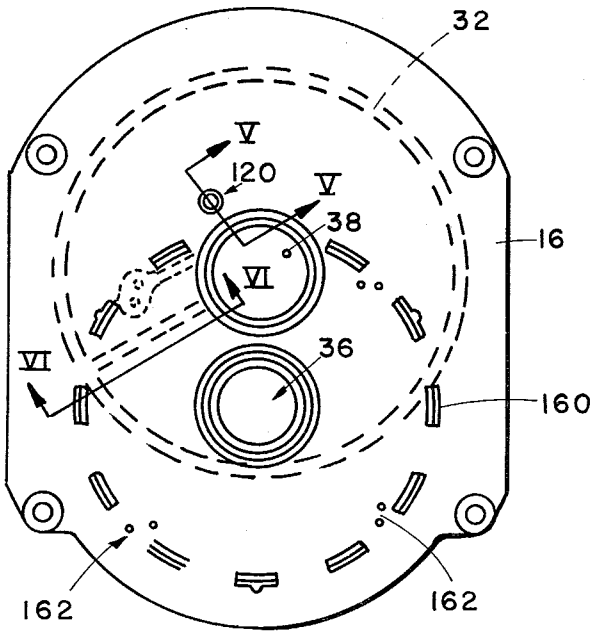
FIG. 3 is a top, plan view of a base plate incorporated in the present invention.

In order to prevent pressure build up within chamber 90 during machine operation, the chamber is communicated with atmosphere through a breather hole 120. As seen in FIGS. 3, 4, and 5, plate 16 is cast with an integral generally tubular member 122. Tubular member 122 defines a through bore 124 which opens at one end within the housing or chamber 90 and at the other end defines the breather hole 120. A suitable, resilient cap 126 (FIG. 5) having a reduced aperture 127 is snap fit into a suitable groove 128 formed in the upper surface of the base plate 16 and surrounding opening 120. Tubular member 122 extends into chamber 90. The length dimension and positioning are such that the quantity of lubricant within the chamber will assume a level below the open end of the bore 124 when the polisher is in a normal position or turned on its side, front, back or upside down. As seen in FIG. 4, the tubular member 122 is preferably formed integral with and immediately adjacent hub 34. Tubular element 122 is positioned relative to the hub so that if the housing is turned on its side or front or rear ends, the lubricant will collect at a point below or to the side of the bore 124.

As a result of the dimensioning and positioning of the tubular element 122, the floor polisher may be stored in any position without leakage of lubricant from the housing chamber 90. When the unit is tipped on its side or turned over, lubricant may drain or drip towards the base plate 16 along the outer peripheral surface of the hub 34. In order to prevent drippage of the lubricant through the bore 124, end 129 of the tubular member is chamfered so as to define a channel 132 between bore 124 and the hub 34. This is best seen in FIG. 5. Channel 132 permits the lubricant to drain away from the bore 124.

As should be apparent from FIG. 2, lowered tapered roller bearing assembly 58 is bathed in the lubricant contained within the housing 90. However, due to the level of lubricant within the housing 90, upper roller bearing assembly 56 would not be lubricated. In accordance with the present invention, provision is made for directing lubricant within the housing into hub 34 to lubricate upper roller bearing assembly 56. This feature of the invention eliminates the need to pack upper roller bearing assembly 56 with grease in order to insure that it is lubricated. This feature simplifies maintenance of the floor polisher and insures increased reliability.

Figure 6:
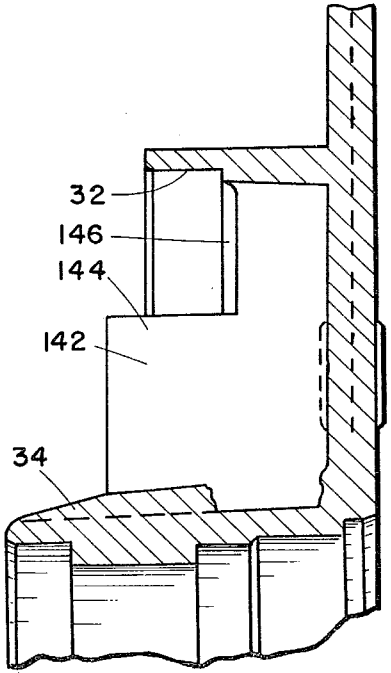
FIG. 6 is a cross sectional view taken generally along line VI—VI of FIG. 3.

As seen in FIGS. 2, 4, 6 and 7, base 16 is cast with a baffle late 142 which extends radially outwardly from hub 34 to the inner surface of annular skirt 32. Baffle plate 142 is stepped in configuration, as seen in FIGS. 2 and 6. The plate is configured so as to extend outwardly in closely spaced relationship with bottom wall 48 of carrier 42 and includes a vertical edge 144 which passes immediately in front of ring gear 96 and a horizontal edge 146 which passes immediately adjacent and overlies the upper surface 147 of vertical flange 50. Circumferentially positioned about hub 34 from the baffle plate 142 in spaced, parallel relationship thereto is another baffle plate 152. Baffle plate 152 extends generally radially outwardly from the hub 34 towards skirt 32 and terminates at a point adjacent ring gear 96. As best seen in FIG. 2 and in the preferred form, the vertical height or dimension of baffle 152 is such that it extends below the horizontal plane defined by the top surface of the annular flange 50 and terminates in closely spaced relationship with bottom wall 48. As seen in FIGS. 2 and 4, hub 34 defines an oil or lubricant inlet 154 and a lubricant outlet 156. Inlet 154 communicates the space within housing chamber 90 between the parallel baffle plates 142, 152 with the interior of the hub 34. Outlet 156 communicates the interior of hub 34 with chamber 90 at a point opposed or immediately opposite inlet 154. Baffle plates 142, 152 in effect define a reservoir space 158 therebetween.

Figure 7:
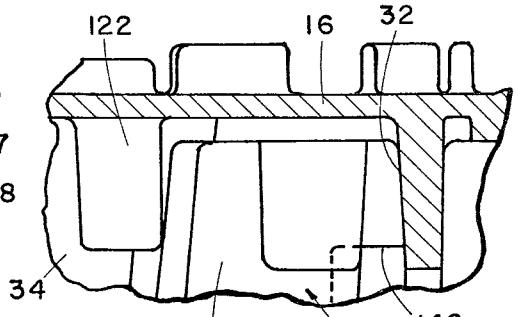
FIG. 7 is a cross sectional view taken generally along line VII—VII of FIG. 4.

During operation of the floor polisher, the carrier and ring gear 96 will be rotated in a counterclockwise direction with respect to base plate 16 when viewed in FIG. 3. Due to friction and boundary layer effects, the liquid lubricant within the housing 90 will move with carrier 42. Centrifugal effects will cause the lubricant level to increase adjacent the vertical flange 50 and the inner periphery of depending skirt 32. As the lubricant is moved with the carrier, it will engage baffle plate 142 and be wiped from the carrier due to the reduced clearance space between the baffle plate 142 and carrier 42, especially at flange 50. The lubricant will collect in space 158 defined by baffle plate 142 and baffle plate 152. As the lubricant collects within this reservoir space 158, its height will increase until the lubricant flows under the action of gravity through the inlet 154 and into the upper portion of the hollow hub 34. The lubricant will then flow over, around and down upper bearing assembly 56. The excess lubricant passed into hub 34 by the baffle structure will exit from the hub through outlet 156. Baffles 142, 152, inlet 154 and outlet 156 insure a continuous flow of lubricant shortly after operation of the polisher commences through the hub to insure complete and adequate lubrication of upper bearing assembly 56. This feature of the invention insures quiet, reliable operation of the polisher. Maintenance is simplified since there is no longer a need to pack the upper bearing assembly with grease. The baffle structure insures that an adequate supply of lubricant is supplied to the bearing assembly at all times. As seen in FIGS. 4 and 7, breather element 122 is circumferentially spaced from baffles 142, 152 along hub 34 in a direction opposite the direction of rotation of the carrier 42. This positioning also insures that lubricant will not enter breather bore 124 during normal operation of the polisher.

The unique polisher and drive in accordance with the present invention is easily manufactured employing conventional die casting and machining techniques. Plate 16 and carrier 42 are die cast and then machined to exact dimensions. Die casting permits the plate 16 to be formed with motor support tabs or lugs 160 (FIGS. 1 and 3). The spaced tabs 160 define cooling air passages with the motor housing 20. Also, plate 16 is drilled at suitable locations 162 to permit bolting of the motor to the top surface of the plate. Baffle 152 at its outer terminal portion 164 is illustrated as being generally egg-shaped in plan (FIG. 4). The baffle defines a boss for mounting of the electric motor. Should the mounting holes be formed in a different pattern on plate 16, baffle 152 may be cast as a simple planar element.

The floor polisher and drive unit in accordance with the present invention is of a reduced complexity when compared to the prior polisher units heretofore proposed. The number and complexity of the parts is reduced and a compact, reliable polisher results. The lubricant within chamber 90 insures quiet, reliable operation of the structure as well as increased life from that heretofore provided. Lubrication of the bearings supporting the spindle within the hub is insured thereby further reducing the noise levels associated with polisher operation. Quick access may be had to the adjustment bolt 70 in order to adjust the bearing preload. The polisher may be stored in any convenient position depending upon the available storage space. Due to the lubrication system, the polisher may be stored on its side, upside down or tilted to its front or back without loss of lubricant.

In view of the foregoing description, those of ordinary skill in the art will undoubtedly envision various modifications to the present invention which would not depart from the inventive concepts disclosed herein. For example, the breather element or tubular member 122 need not be cast integral with the hub structure 34. This member could be a separate tube inserted through the plate 16. Further, the exact positioning and configuration of baffles 142, 152 could be varied from that illustrated while still achieving the same desired results of causing liquid lubricant to collect and flow over the upper bearing assembly. Therefore, it is expressly intended that the above description should be considered as that of the preferred embodiment. The true spirit and scope of the present invention may be determined by reference to the appended claims.

The embodiments of the invention in which an exclusive property or privilege is claimed are defined as follows.

1. A drive for a compact rotary floor maintenance device, comprising:

a motor support base having a depending, annular skirt and a depending hub concentric with said skirt, said base having a motor shaft aperture therein;

a carrier having a generally vertical annular flange and a centrally disposed spindle, said spindle extending into said hub;

means within said hub for supporting said spindle for rotary motion, said carrier and said skirt defining a drive housing within which a liquid lubricant may be disposed;

a ring gear on said annular flange and engageable by a pinion gear secured to a motor shaft extending through the motor shaft aperture;

seal means carried by one of said annular skirt and said flange for sealing the space between said flange and said skirt to prevent leakage of lubricant therethrough; and breather means carried by said base and extending into said drive housing for communicating said housing with atmosphere, preventing a build up of pressure within the housing during drive operation and for permitting said housing to be stored in any position without leakage of lubricant from said drive housing.

2. A drive as defined by claim 1 wherein said breather means is a tubular member extending from said base into said housing and positioned adjacent said hub.

3. A drive as defined by claim 2 wherein said tubular member includes a chamfered terminal end portion, said member defining a bore for communicating said housing with atmosphere.

4. A drive as defined by claim 3 wherein said tubular member is integral with said hub.

5. A drive as defined by claim 4 wherein said means for supporting said spindle comprises:

a pair of vertically spaced, tapered roller bearing assemblies, each assembly including an outer race carried by said hub, an inner race engaging and surrounding said spindle and a plurality of tapered roller bearings positioned between and riding on said races; and adjustment means carried by said spindle for adjusting the preload on said bearing assemblies.

6. A drive as defined by claim 5 wherein said hub opens through the top surface of said motor support base, said adjustment means being accessible through said hub from the top surface of said base, said drive further including a removable closure plate carried by said base for closing said hub at its upper end.

7. A drive as defined by claim 1 further including means within said housing for directing lubricant within the housing into said hub for lubricating said means for supporting said spindle for rotary motion.

8. A drive as defined by claim 7 wherein said means for directing lubricant comprises:

baffle means carried by said base plate for baffling lubricant moved with the carrier, collecting the lubricant and directing the lubricant towards the hub, said hub defining a lubricant inlet at said baffle means and a lubricant outlet whereby lubricant may pass through said hub and lubricate said spindle supporting means.

9. A drive as defined by claim 8 wherein said baffle means comprises:

a first baffle plate extending radially outwardly from said hub and terminating at said skirt; and a second baffle plate circumferentially spaced from said first baffle plate, extending from said hub and terminating adjacent said vertical flange, said baffle plates defining a reservoir for the collection of lubricant carried with said brush carrier.

10. A drive as defined by claim 2 further including means within said housing for directing lubricant within the housing into said hub for lubricating said means for supporting said spindle for rotary motion.

11. A drive as defined by claim 10 wherein said means for directing lubricant comprises:

baffle means carried by said base plate for baffling lubricant carried with the carrier, collecting the lubricant and directing the lubricant towards the hub, said hub defining a lubricant inlet at said baffle means and a lubricant outlet whereby lubricant may pass through said hub and lubricate said spindle supporting means.

12. A drive as defined by claim 11 wherein said baffle means comprises:

a first baffle plate extending radially outwardly from said hub and terminating at said skirt; and a second baffle plate circumferentially spaced from said first baffle plate, extending from said hub and terminating adjacent said vertical flange, said baffle plates defining a reservoir for the collection of lubricant carried along with said brush carrier.

13. A drive as defined by claim 5 further including means within said housing for directing lubricant within the housing into said hub for lubricating said means for supporting said spindle for rotary motion.

14. A drive as defined by claim 13 wherein said means for directing lubricant comprises:

baffle means carried by said base plate for baffling lubricant carried with the carrier, collecting the lubricant and directing the lubricant towards the hub, said hub defining a lubricant inlet at said baffle means and a lubricant outlet whereby lubricant may pass through said hub and lubricate said spindle supporting means.

15. A drive as defined by claim 14 wherein said baffle means comprises:

a first baffle plate extending radially outwardly from said hub and terminating at said skirt; and a second baffle plate circumferentially spaced from said first baffle plate, extending from said hub and terminating adjacent said vertical flange, said baffle plates defining a reservoir for the collection of lubricant carried along with said brush carrier.

16. An improved compact floor polisher of the type including an electric motor secured to a base plate and having a vertically disposed output shaft, a handle, a polising brush and drive means for interconnecting the output shaft of the motor to the polishing brush, said drive means comprising:

a brush carrier having a generally vertical annular flange and a vertically extending spindle, said brush being secured to said carrier for rotation therewith, said base plate including a depending skirt concentric with said carrier and surrounding said carrier flange;

a hub having a through bore and extending from said base plate, said spindle disposed within said through bore of said hub;

bearing means within said hub and connecting said spindle to said hub for rotary motion relative thereto;

rotary seal means between said vertical flange and said skirt for sealing the space between said flange and said skirt, said carrier and said base defining a drive housing for containing a liquid lubricant;

means within said housing for directing lubricant into said hub to lubricate said bearing means; and a tubular member extending from said base into said housing adjacent said hub, said tubular member defining a breather passage communicating said housing with atmosphere, said tubular member positioned so that said floor polisher may be stored in any position without leakage of lubricant from the housing.

17. An improved compact floor polisher as defined by claim 16 wherein said means for directing lubricant comprises:

a pair of circumferentially spaced baffles extending outwardly from said hub, said hub defining a lubricant inlet communicating said housing with said hub bore between the baffles, said baffles dimensioned so that as the carrier rotates lubricant moved along therewith will collect between the baffles and flow through the inlet into the hub bore and lubricate the bearings.

18. An improved compact floor polisher as defined by claim 17 wherein said tubular member is integral with said hub and is chamfered at its lower end to define a channel preventing lubricant from entering the breather passage when the polisher is stored on its side or upside down.

19. A compact drive for use with a motor having a pinion gear rotated by the motor output shaft, said drive adapted for use in a floor polisher and comprising:

a base plate to which the motor may be mounted and having a depending, generally circular skirt and a hollow hub concentric with said skirt;

a carrier having a peripheral, vertical flange disposed within the skirt and defining a lubricant housing therewith, said carrier including a spindle concentric with the flange and extending within the hub;

bearing means within the hub connecting the carrier to the base plate for relative rotation therewith;

a ring gear on an inner peripheral surface of said vertical flange, said base plate including a motor shaft aperture therethrough positioned so that the pinion gear on the output shaft will engage the ring gear;

a seal supported by said skirt and engaging the outer peripheral surface of the vertical flange;

means within said housing for directing lubricant within the housing into the hub to lubricate the bearing means, said lubricant directing means comprising:

a first baffle extending radially outwardly from the hub within said housing and terminating adjacent the vertical flange; and a second baffle extending outwardly from the hub and terminating adjacent the skirt, said second baffle positioned circumferentially from the first baffle in the direction of carrier rotation, said first and second baffles defining a reservoir for collection of lubricant and said hub defining an inlet opening between the baffles and communicating the interior of the hub with the housing, said hub defining an outlet communicating the hub interior with the housing, said outlet being positioned opposite of said inlet, said carrier including a bottom wall connecting the vertical flange to the spindle, said second baffle extending from the base plate along said carrier bottom wall, said first baffle extending from the base plate below an upper surface of the vertical flange, and said base plate defining a breather tube extending into the housing adjacent the hub and communicating the housing with atmosphere, said breather tube dimensioned and positioned to permit said housing to be tipped in any position without leakage of lubricant therethrough.

20. An improved compact floor polisher of the type including an electric motor secured to a base plate and having a vertically disposed output shaft, a handle, a polishing brush and drive means for interconnecting the output shaft of the motor to the polishing brush, said drive means comprising:

a brush carrier having a generally vertical annular flange and a vertically extending spindle, said brush being secured to said carrier for rotation therewith, said base plate including a depending skirt concentric with said carrier and surrounding said carrier flange;

a hub having a through bore and extending from said base plate, said spindle disposed within said through bore of said hub;

bearing means within said hub and connecting said spindle to said hub for rotary motion relative thereto;

rotary seal means between said vertical flange and said skirt for sealing the space between said flange and said skirt, said carrier and said base defining a drive housing for containing a liquid lubricant; and breather means extending into said housing from said base for communicating said housing with atmosphere, preventing a pressure build up within the housing during drive means operation and for permitting said floor polisher to be stored in any position without leakage of lubricant from said drive housing.

21. An improved compact floor polisher as defined by claim 20 wherein said breather means comprises a tubular member defining a breather passageway and having a chamfered terminal end portion, said tubular member being adjacent said hub and integral therewith.

22. A compact drive for use with a motor having a pinion gear rotated by the motor output shaft, said drive adapted for use in a floor polisher and comprising:

a base plate to which the motor may be mounted and having a depending, generally circular skirt and a hollow hub concentric with said skirt;

a carrier having a peripheral, vertical flange disposed within the skirt and defining a lubricant housing therewith, said carrier including a spindle concentric with the flange and said circular skirt and extending within the hub;

bearing means within the hub connecting the carrier to the base plate for relative rotation therewith;

a ring gear on an inner peripheral surface of said vertical flange, said base plate including a motor shaft aperture therethrough positioned so that the pinion gear on the output shaft will engage the ring gear;

a seal supported by said skirt and engaging the outer peripheral surface of the vertical flange; and breather means extending from said base plate into said lubricant housing adjacent said hub for communicating said housing with atmosphere, preventing a pressure build up within the housing during drive operation and for permitting said drive to be stored in any position without leakage of lubricant from said housing.

23. A compact drive as defined by claim 22 wherein said breather means comprises a tubular member defining a breather passageway opens into said housing at one end and through said base plate at the other end, said tubular member being chamfered at said one end to define a channel with said hub preventing leakage of lubricant draining off said hub when said drive is turned upside down.

24. An improved drive for a rotary floor treating machine of the type including a base defining a depending skirt and a concentric depending hub, a motor having a vertical output shaft extending through the base offset from said hub, a seal surrounding the shaft, a floor treating element carrier having a spindle disposed within the hub and a vertical flange positioned within the skirt, the flange and skirt defining a lubricant housing, bearing means within the hub for supporting the spindle, and gear means for interconnecting said output shaft to said carrier wherein the improvement comprises:

a rotary seal carried by one of said skirt and said flange and sealing the space between the flange and skirt; and breather means extending from the base adjacent the hub and into the housing for communicating the housing with atmosphere and permitting the drive to be stored in any position without leakage of lubricant from the housing.

25. An improved drive as defined by claim 24 wherein the improvement further comprises:

means within the housing for directing lubricant into the hub during drive operation to lubricate the bearing means.

26. An improved drive as defined by claim 25 wherein said breather means comprises a tubular member integral with the base and hub and defining a passageway opening at one end into the housing, said one end of the tubular member being chamfered to define a channel with said hub.

27. An improved drive as defined by claim 26 wherein said means for directing lubricant comprises:

a first baffle extending radially outwardly from the hub; and a second baffle circumferentially spaced from said first baffle along the hub and extending outwardly from the hub in parallel relationship to the first baffle, said baffles defining a lubricant reservoir and said hub defining an inlet between the baffles for permitting lubricant to flow into the hub and an outlet opposite the inlet for permitting lubricant to flow out of said hub and into the housing.

* * * * *

UNITED STATES PATENT AND TRADEMARK OFFICE

CERTIFICATE OF CORRECTION

PATENT NO. : 4,214,337

DATED : July 29, 1980

INVENTOR(S) : Wilfred C. Nise, Bertel S. Nelson

It is certified that error appears in the above-identified patent and that said Letters Patent are hereby corrected as shown below:

Column 4, line 58:

"late" should be --plate--;

Column 8, line 23:

"polising" should be --polishing--;

Column 10, line 44:

"opens" should be --opening--.

Signed and Sealed this

*Eleventh* Day of *November 1980*

[SEAL]

*Attest:*

SIDNEY A. DIAMOND

*Attesting Officer*

*Commissioner of Patents and Trademarks*